US011241903B2

(12) United States Patent
Yu

(10) Patent No.: US 11,241,903 B2
(45) Date of Patent: Feb. 8, 2022

(54) LIFT-PULL PEN

(71) Applicant: Hangzhou Jianyi Technology Co., Ltd., Zhejiang (CN)

(72) Inventor: Chengpeng Yu, Zhejiang (CN)

(73) Assignee: Hangzhou Jianyi Technology Co., Ltd., Hangzhou (CN)

( * ) Notice: Subject to any disclaimer, the term of this patent is extended or adjusted under 35 U.S.C. 154(b) by 34 days.

(21) Appl. No.: 16/937,459

(22) Filed: Jul. 23, 2020

(65) Prior Publication Data

US 2021/0023871 A1 Jan. 28, 2021

(30) Foreign Application Priority Data

Jul. 27, 2019 (CN) ..... 201910685513.3

(51) Int. Cl.
*B43K 24/02* (2006.01)

(52) U.S. Cl.
CPC ..... *B43K 24/02* (2013.01)

(58) Field of Classification Search
CPC ..... B43K 24/02; B43K 5/005; B43K 5/16
See application file for complete search history.

(56) References Cited

U.S. PATENT DOCUMENTS

| | | | | |
|---|---|---|---|---|
| 4,780,016 | A * | 10/1988 | Kim | B43K 23/10 401/116 |
| 10,718,514 | B1 * | 7/2020 | Yu | F23G 5/24 |
| 10,960,705 | B1 * | 3/2021 | Yu | B43K 25/028 |
| 10,974,540 | B1 * | 4/2021 | Yu | B43K 7/12 |
| 2019/0023057 | A1 * | 1/2019 | Davies-Smith | B43K 7/005 |

* cited by examiner

*Primary Examiner* — J C Jacyna

(57) ABSTRACT

The present invention relates to a lift-pull pen, which includes a pen point tube, an outer tube, a refill and a return spring. The pen point tube and the outer tube are nested to form an outer pen shell. The refill is located in the outer pen shell. The return spring is located in the pen point tube and specifically located between a pen point end of the refill and the pen point tube. The pen point tube extends to be provided with one or a plurality of buckle extension bodies and one or a plurality of fixed extension columns extend from the pen point tube.

10 Claims, 12 Drawing Sheets

B-B

LIFT-PULL PEN

CROSS-REFERENCE TO RELATED APPLICATIONS

This application claims the benefit of priority from Chinese Patent Application No. 201910685513.3, filed on Jul. 27, 2019. The content of the aforementioned application, including any intervening amendments thereto, is incorporated herein by reference in its entirety.

TECHNICAL FIELD

The present invention relates to a pen, and particularly relates to a lift-pull pen.

BACKGROUND OF THE PRESENT INVENTION

Nowadays, with the rapid development of science and technology, the quality of human life has been improved continuously. However, the improvement and research on pens remain stagnant. Although today is an era of artificial intelligence, and computers and mobile phones have taken over the life of people, as a traditional civilization record mode, the pen is necessary to exist and is still irreplaceable at present.

The pen has two important points: first, refills; and second, the structural design of outer pen shells. With respect to the above two points, the improvement and research have been always made by people. The design technology of the existing pen shell is already mature, but the operating mode is single, and the operating steps are complicated. At present, ergonomics is emphasized, but for the ergonomics of the pen, only the grip of the pen when in writing is generally improved ergonomically. However, the improvement of the most fundamental operating mode has been neglected.

SUMMARY OF THE PRESENT INVENTION

The purpose of the present invention is to solve the problem that the existing pen is complicated in operating steps, and to provide a lift-pull pen.

To realize the above purpose, the present invention adopts the following technical solutions:

A lift-pull pen includes a pen point tube, an outer tube, a refill and a return spring. The pen point tube and the outer tube are nested to form an outer pen shell. The refill is located in the outer pen shell. The return spring is located in the pen point tube and specifically located between a pen point end of the refill and the pen point tube.

The pen point tube extends to be provided with one or a plurality of buckle extension bodies and one or a plurality of fixed extension columns. The buckle extension body is provided with a buckle projection and a return slope. The front end of the buckle projection is also provided with an entrance auxiliary slope. The return slope has certain slope gradient. A matching groove is also arranged between the return slope and the buckle projection. The fixed extension column is composed of a contact supporting area and a sliding matching area.

The front end of the outer tube extends to be provided with inner buckle extension columns having a same number with that of the buckle extension columns and outer fixed columns having a same number with that of the fixed extension columns. The front end of the inner buckle extension column is provided with an inner buckle lug boss. The inner buckle lug boss can enter and exit the matching groove. The inner side of the outer fixed column is also provided with a fixed chute. The fixed extension column is slidably sleeved in the fixed chute. The inner side of the front end of the outer fixed column is also provided with an anti-falling inner projection. The anti-falling inner projection can slide arbitrarily in a range of a sliding matching area but needs an external force to enter and exit the contact supporting area.

The inner buckle lug boss can pass through the buckle projection rapidly to enter the matching groove through the entrance auxiliary slope. Then through the gradient of the return slope, the inner buckle lug boss and the buckle extension bodies are deformed together. When the external force disappears, under the action of an elastic force of the return spring, the buckle extension bodies can be bounced rapidly to leave the return slope contacting same. When the buckle extension bodies are bounced back to a space above the matching groove, because the deformed buckle extension bodies are still not restored to a normal state, the inner buckle lug boss leaves a matching range of the matching groove before entering the matching groove. When the buckle extension bodies are restored to a static normal state, the buckle extension bodies already leave a contact range of the pen point tube.

Preferably, the position changes of the pen point tube and the outer tube include the following two situations:

First, when the inner buckle lug boss enters the matching groove, the pen is in a use state, and at this time, a writing pen point portion of the refill is exposed out of the pen point tube.

Second, when the inner buckle lug boss is separated from the matching groove through the return slope, the writing pen point of the refill is completely concealed in the outer pen shell, and the inner buckle lug boss and the pen point tube do not contact each other; and the pen is in an unused state.

Preferably, the contact supporting area can separate a partial area to form a self-locking area. Two sides of the self-locking area are respectively provided with a self-locking projection. The inner buckle lug boss can enter the self-locking projection.

Preferably, the position changes of the pen point tube and the outer tube include the following three situations:

First, when the anti-falling inner projection contacts the contact supporting area, the outer pen shell has a maximum use length and the pen is in an unused state, and the refill is in a state of being completely concealed in the outer pen shell.

Second, when the inner buckle lug boss stands in the matching groove, the pen is in a use state, and the writing pen point portion of the refill has an optimum exposed length.

Third, when the inner buckle lug boss contacts the top end of the return slope, the outer pen shell has a minimum use length and the pen is in a to-be-released state. If the interference of the external force is relieved after the outer pen shell reaches the minimum use length, the outer pen shell may be bounced directly to reach the maximum use length and to enter the unused state.

Preferably, the position changes of the pen point tube and the outer tube include the following four situations:

First, when the anti-falling inner projection contacts the self-locking projection but does not enter the self-locking area, the pen is the unused state at this time, and the refill is in a state of being completely concealed in the outer pen shell.

Second, when the anti-falling inner projection is matched with the self-locking projection and is located in the self-locking area, the outer pen shell reaches the maximum use length and is in the self-locked state, and the refill is in a state of being completely concealed in the outer pen shell and is further retracted into the outer pen shell.

Third, when the inner buckle lug boss stands in the matching groove, the pen is in a use state, and the writing pen point portion of the refill has an optimum exposed length.

Fourth, when the inner buckle lug boss contacts the top end of the return slope, the outer pen shell has a minimum use length and is in a to-be-released state. If the interference of the external force is relieved after the outer pen shell reaches the minimum use length, the outer pen shell may be bounced directly to reach the maximum use length and to enter the unused state.

Preferably, the front end of the inner buckle lug boss is also provided with the inner buckle auxiliary slope. The gradient of the inner buckle auxiliary slope is consistent with the gradient of the return slope.

Preferably, the front end of the contact supporting area is also provided with a mounting auxiliary slope.

Preferably, the length of the fixed extension column is greater than the buckle extension body.

Preferably, the length of the outer fixed column is greater than the length of the inner buckle extension column.

Preferably, the outer tube is externally sleeved with an antiskid sleeve. The outer surface of the outer tube is also provided with a lantern ring. An inner lantern ring groove is arranged inside the antiskid sleeve. The inner lantern ring groove is matched with the lantern ring.

An assembling mode includes:

1, placing the refill into the outer tube at first;

2, then, sleeving the refill with the return spring;

3, finally, placing the pen point tube into the outer tube.

Compared with the prior art, by adopting the above technical solutions, the present invention has the following beneficial effects:

First, the assembling is simple, and fewer components are used.

Second, the retraction and extension of the refill can be rapidly operated, and the use state and the unused state can be switched.

Third, a self-locking function is provided, thereby facilitating the carry outside.

DETAILED DESCRIPTION OF THE PRESENT INVENTION

The present invention is further described below in combination with the accompanying drawings.

Embodiments

Figure 1:
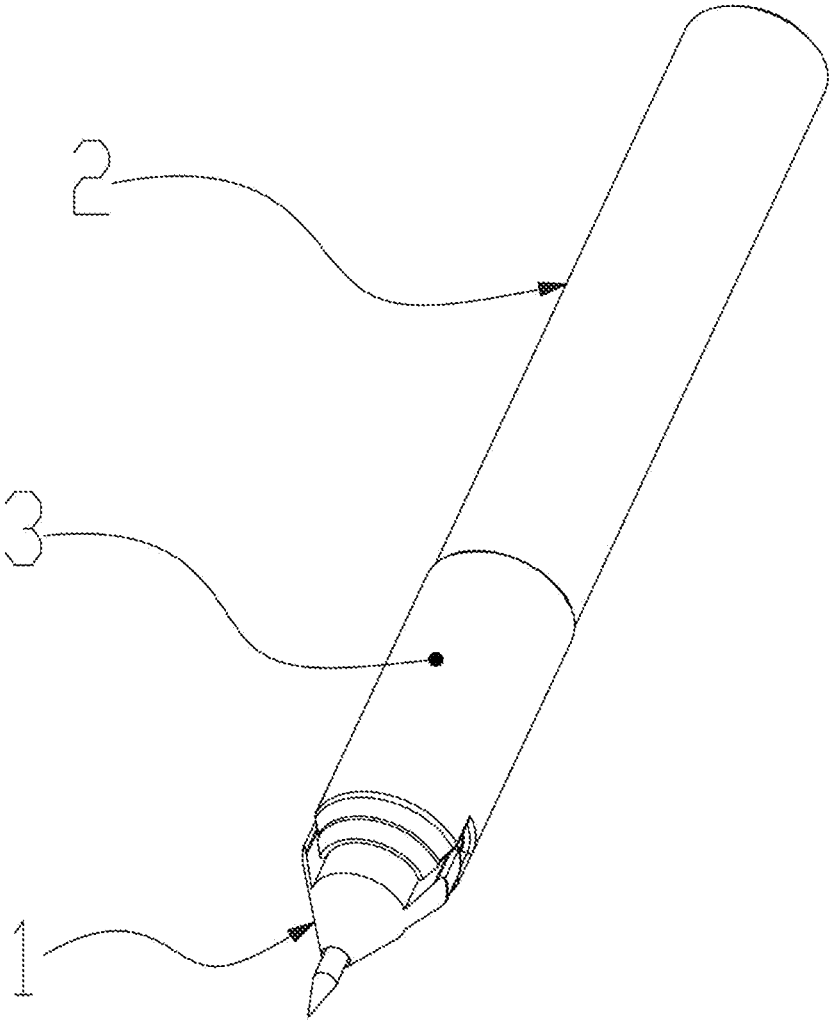
FIG. 1 is a stereoscopic diagram of embodiments of the present invention.
Figure 2:
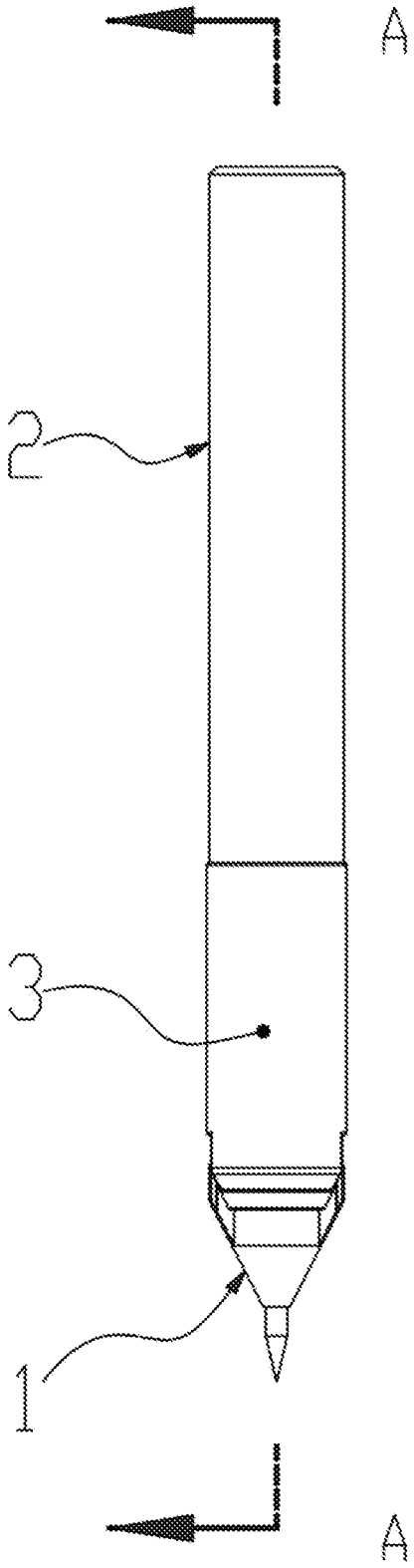
FIG. 2 is a front view of the embodiments of the present invention.
Figure 3:
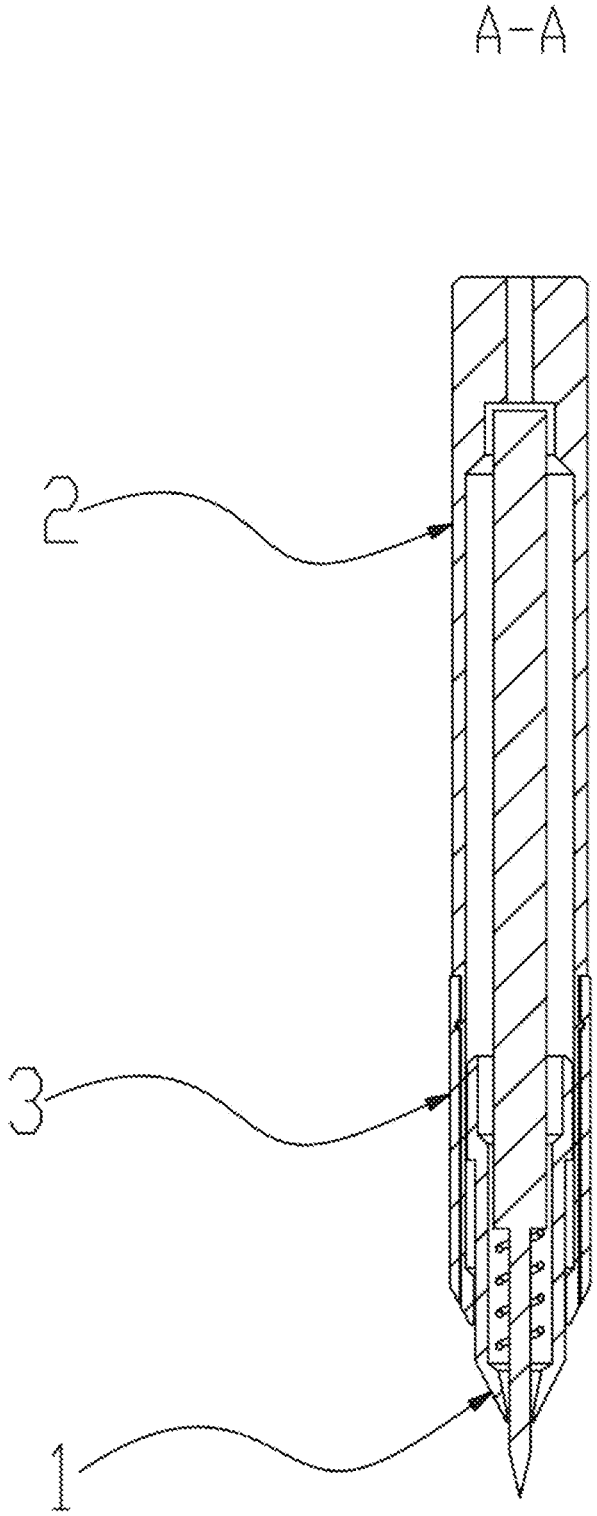
FIG. 3 is a sectional view of an A-A position in FIG. 2 of the present invention.
Figure 4:
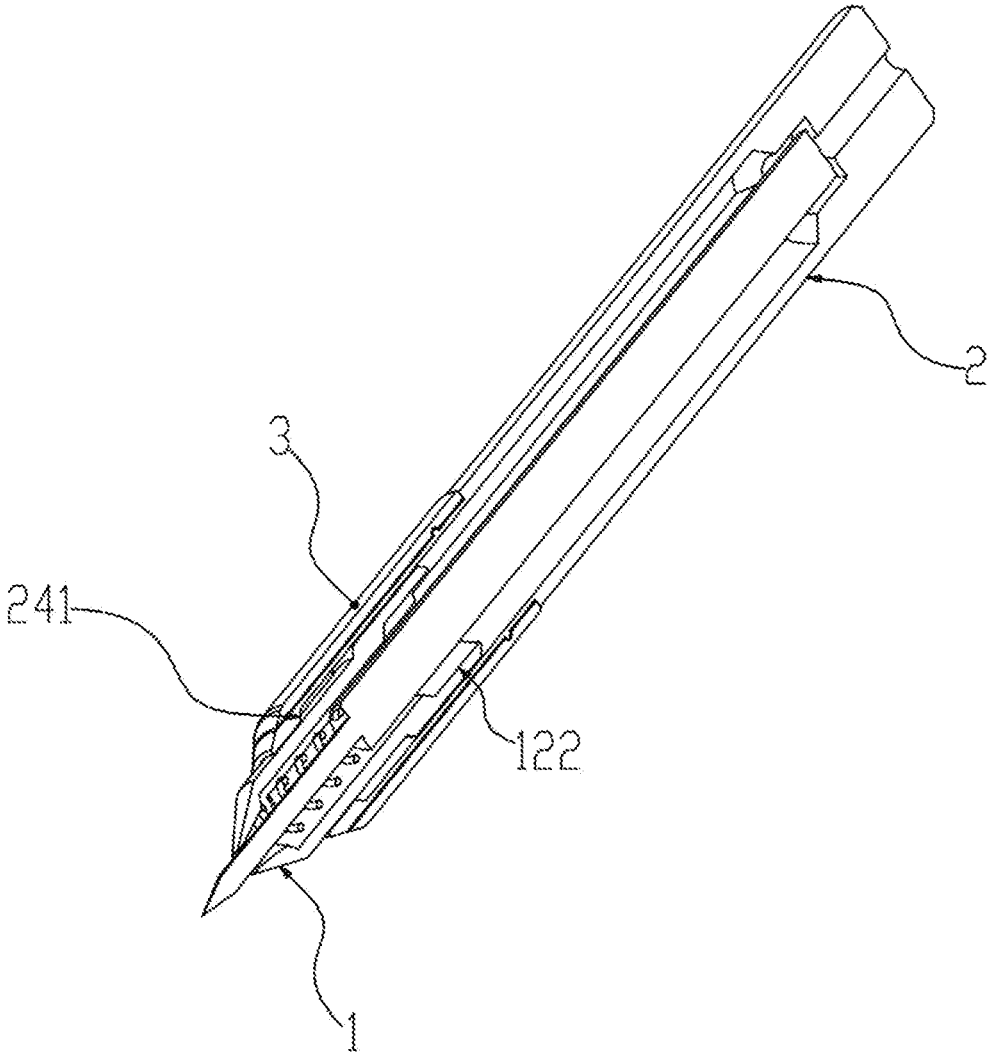
FIG. 4 is a stereoscopic diagram of FIG. 3 of the present invention.
Figure 5:
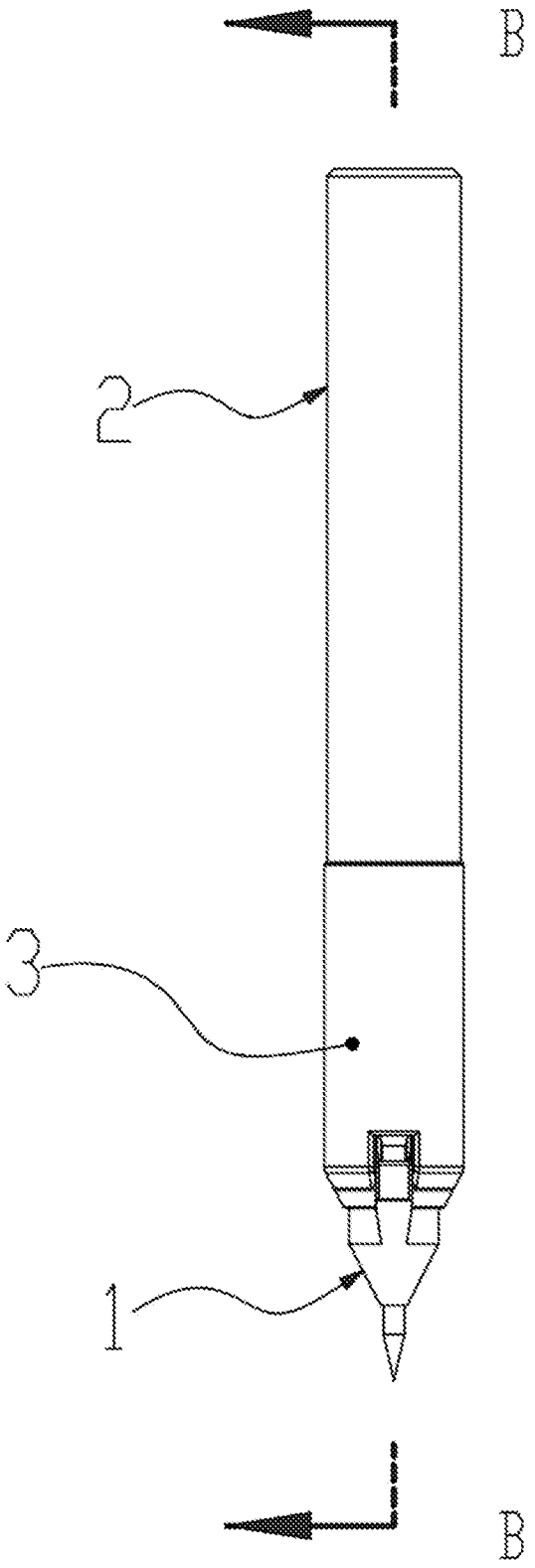
FIG. 5 is a left view of the embodiments of the present invention.
Figure 6:
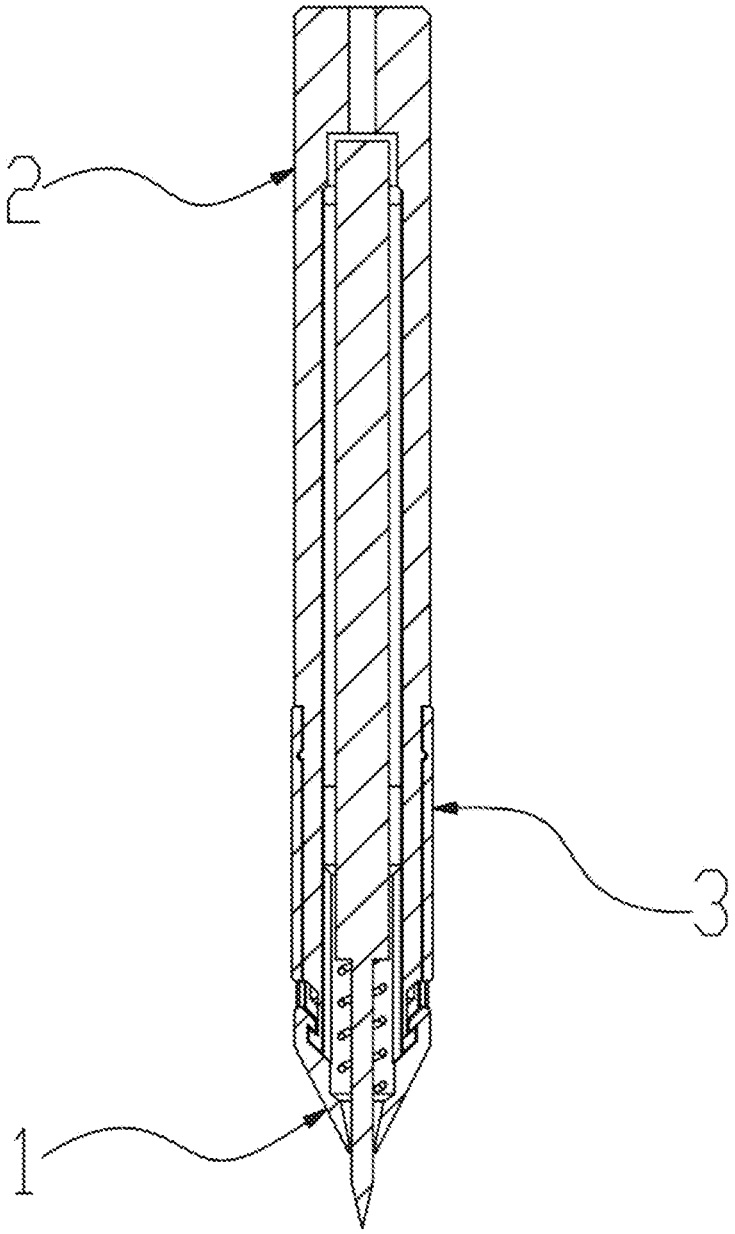
FIG. 6 is a sectional view of a B-B position in FIG. 5 of the present invention.
Figure 7:
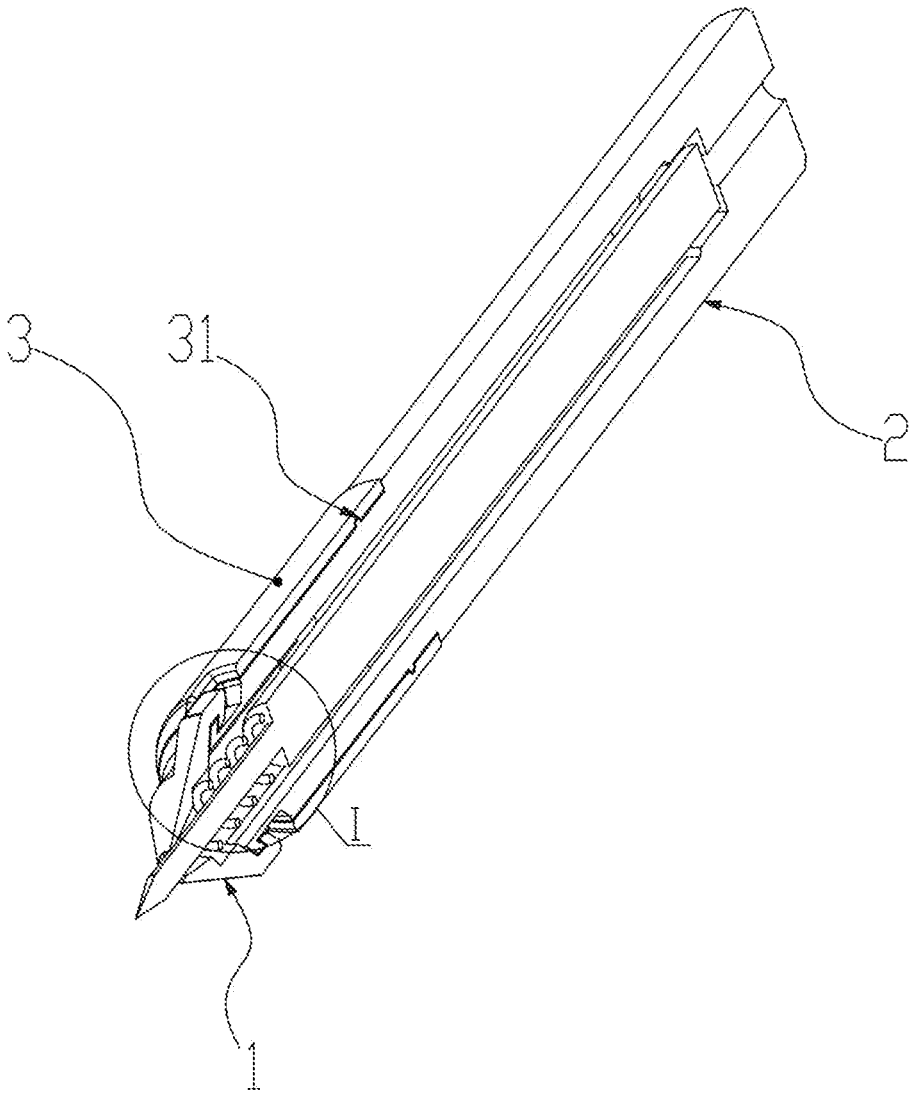
FIG. 7 is a stereoscopic diagram of FIG. 6 of the present invention.
Figure 8:
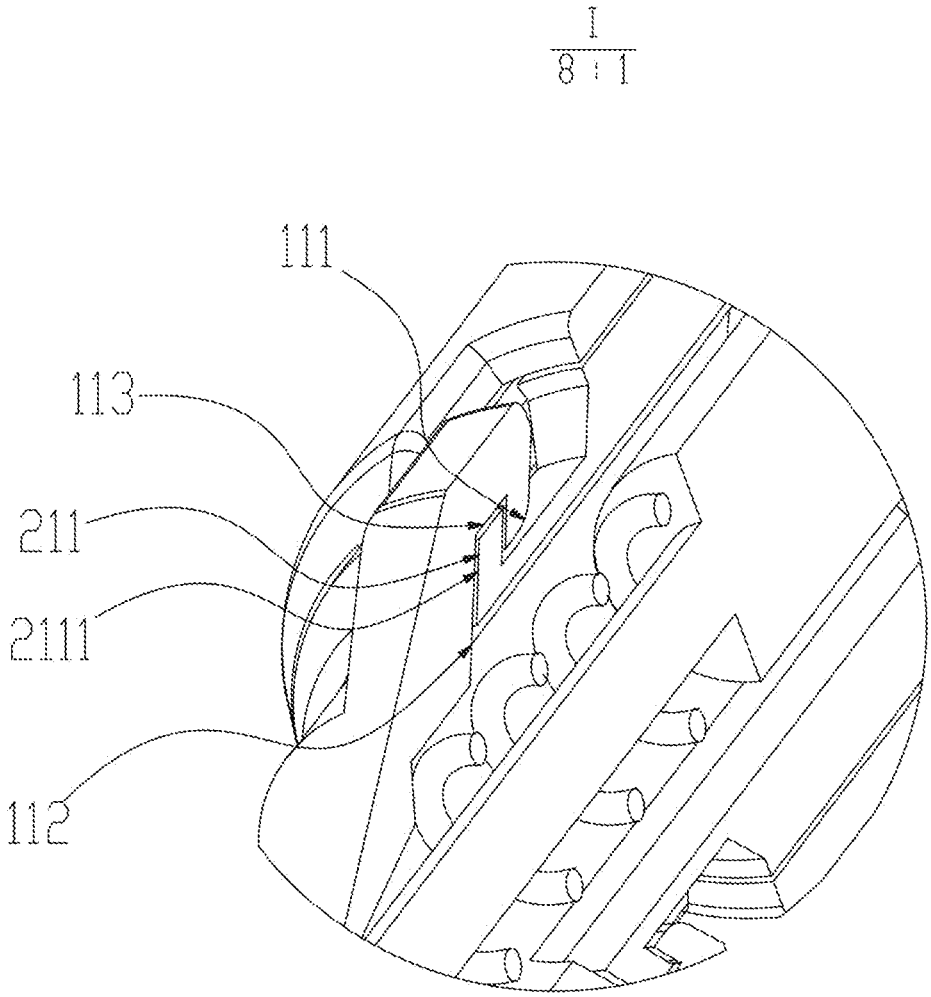
FIG. 8 is a local enlarged view of a position I in FIG. 7 of the present invention.
Figure 9:
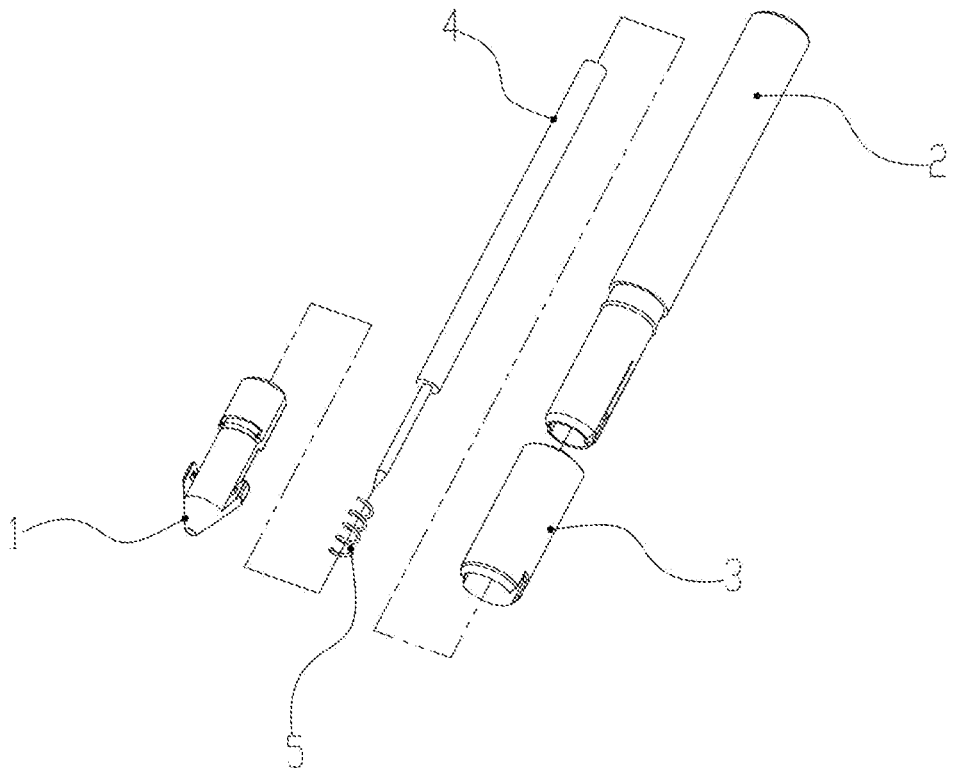
FIG. 9 is an explosive view of the embodiments of the present invention.
Figure 10:
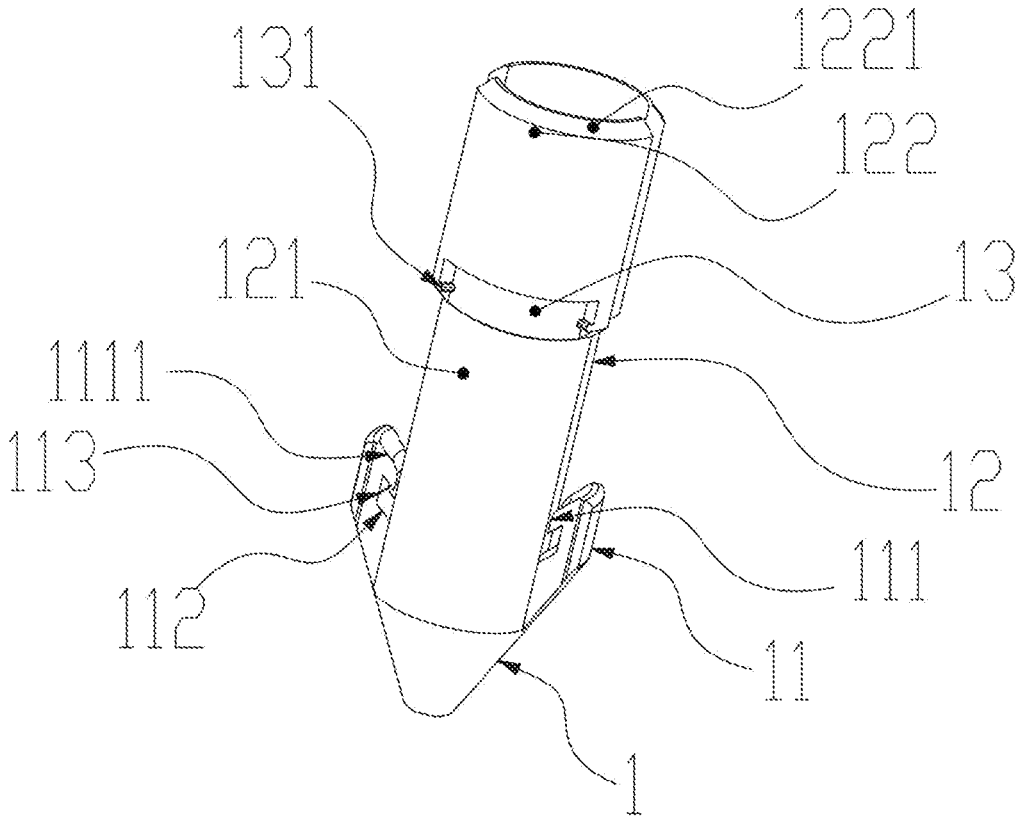
FIG. 10 is a stereoscopic diagram of a pen point tube of the present invention.
Figure 11:
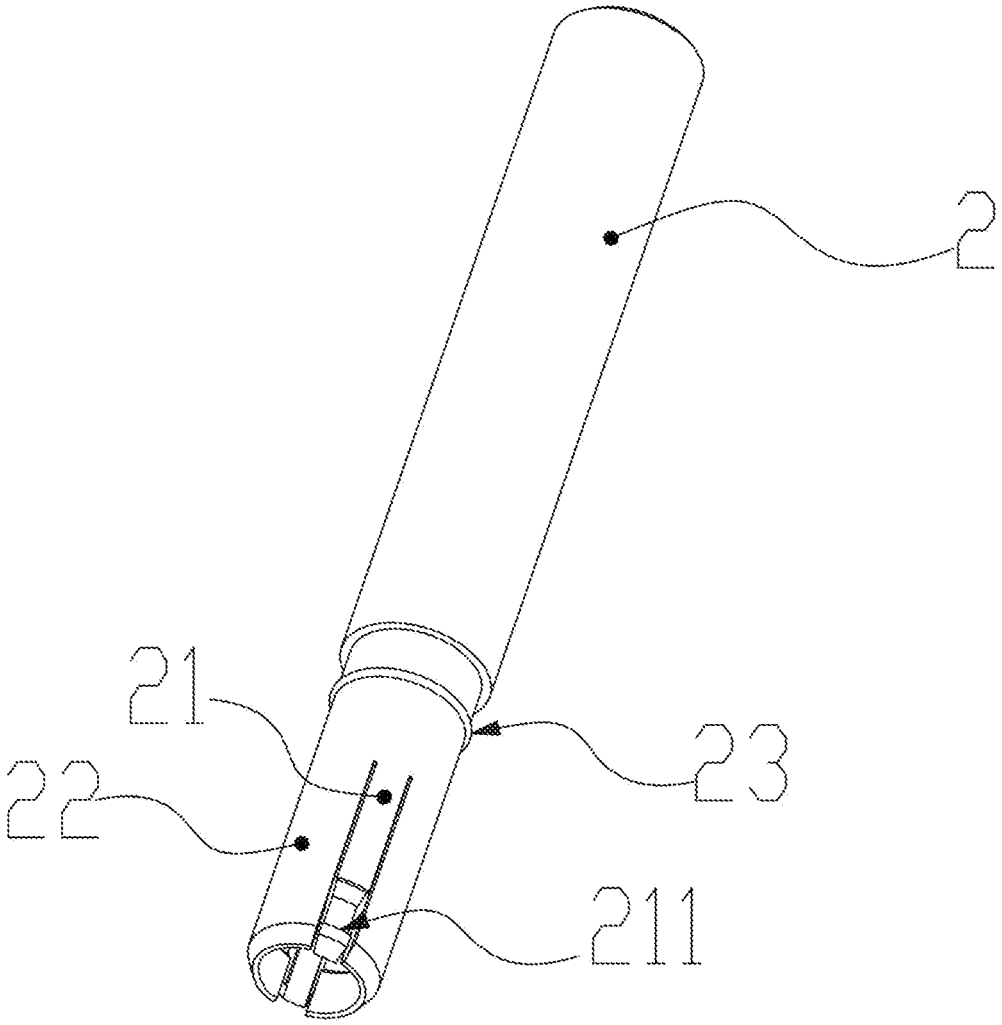
FIG. 11 is a stereoscopic diagram of an outer tube of the present invention.
Figure 12:
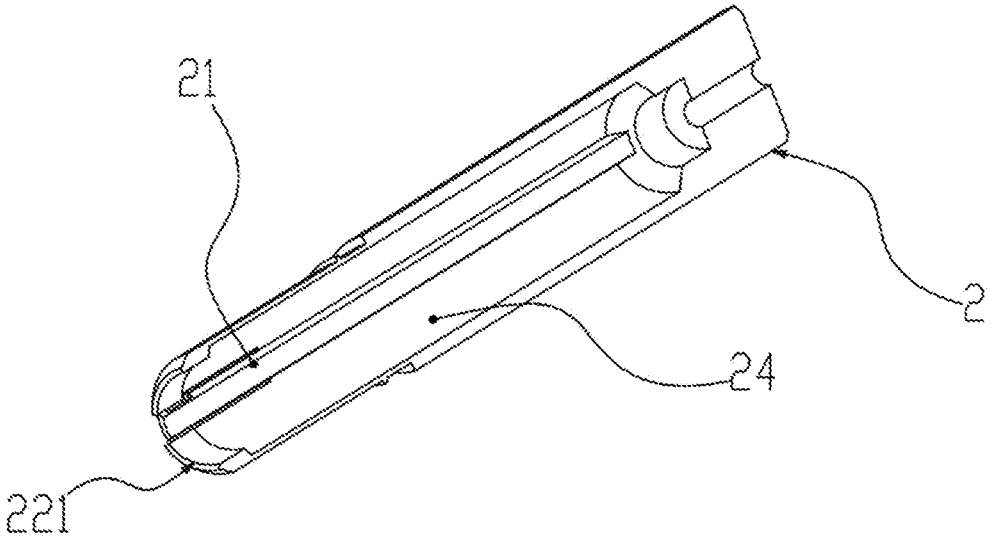
FIG. 12 is a stereoscopic sectional view of an outer tube of the present invention.

As shown in FIG. 1 to FIG. 12, a lift-pull pen includes a pen point tube 1, an outer tube 2, a refill 4 and a return spring 5. The pen point tube 1 and the outer tube 2 are sleeved to form an outer pen shell. The refill 4 is located in the outer pen shell. The return spring 5 is located in the pen point tube 1 and specifically located between a pen point end of the refill 4 and the pen point tube 1.

The pen point tube 1 extends to be provided with one or a plurality of buckle extension bodies 11 and one or a plurality of fixed extension columns 12. The buckle extension body 11 is provided with a buckle projection 111 and a return slope 112. The front end of the buckle projection 111 is also provided with an entrance auxiliary slope 1111. The return slope 112 has certain slope gradient. A matching groove 113 is also arranged between the return slope 112 and the buckle projection 111. The fixed extension column 12 is composed of a contact supporting area 122 and a sliding matching area 121.

The front end of the outer tube 2 extends to be provided with inner buckle extension columns 21 having a same number with that of the buckle extension columns 11 and outer fixed columns 22 having a same number with that of the fixed extension columns 12. The front end of the inner buckle extension column 21 is provided with an inner buckle lug boss 211. The inner buckle lug boss 211 can enter and exit the matching groove 113. The inner side of the outer fixed column 22 is also provided with a fixed chute 24. The fixed extension column 12 is slidably sleeved in the fixed chute 24. The inner side of the front end of the outer fixed column 22 is also provided with an anti-falling inner projection 221. The anti-falling inner projection 221 can slide arbitrarily in a range of the sliding matching area 121, but needs an external force to enter and exit the contact supporting area 122.

The inner buckle lug boss 211 can pass through the buckle projection 111 rapidly to enter the matching groove 113 through the entrance auxiliary slope 1111. Then through the gradient of the return slope 112, the inner buckle lug boss 211 and the buckle extension bodies 11 are deformed together. When an external force disappears, under the action of an elastic force of the return spring 5, the buckle extension bodies 11 can be bounced rapidly to leave the return slope 112 contacting same. When the buckle extension bodies are bounced back to a space above the matching groove 113, because the deformed buckle extension bodies are still not restored to a normal state, the inner buckle lug boss 211 leaves a matching range of the matching groove 113 before entering the matching groove 113. When the buckle extension bodies 11 are restored to a static normal state, the buckle extension bodies 11 already leave a contact range of the pen point tube 1.

The position changes of the pen point tube 1 and the outer tube 2 include the following two situations:

Third, when the inner buckle lug boss 211 enters the matching groove 113, the pen is a use state, and at this time, a writing pen point portion of the refill is exposed out of the pen point tube 1.

Fourth, when the inner buckle lug boss 211 is separated from the matching groove 113 through the return slope 112, the writing pen point of the refill is completely concealed in the outer pen shell, and the inner buckle lug boss 211 and the pen point 1 tube do not contact each other; and the pen is in an unused state.

In order to facilitate the carry outside and prevent the exposed refill suffering the external force from being polluted, the contact supporting area 122 can separate a partial area to form a self-locking area 13. Both sides of the self-locking area 13 are provided with a self-locking projection 131. The inner buckle lug boss 211 can enter the self-locking projection 131.

The position changes of the pen point tube 1 and the outer tube 2 include the following four situations:

First, when the anti-falling inner projection 221 contacts the self-locking projection 131 but does not enter the self-locking area 13, the pen is in the unused state, and the refill is in a state of being completely concealed in the outer pen shell.

Second, when the anti-falling inner projection 221 is matched with the self-locking projection 131 and is located in the self-locking area 13, the outer pen shell reaches the maximum use length and then is in the self-locked state, and the refill is in a state of being completely concealed in the outer pen shell and is further retracted into the outer pen shell.

Third, when the inner buckle lug boss 211 stands in the matching groove 113, the pen is in a use state, and the writing pen point portion of the refill has an optimum exposed length.

Fourth, when the inner buckle lug boss 211 contacts the top end of the return slope 112, the outer pen shell has a minimum use length and is in a to-be-released state. If the interference of the external force is relieved after the outer pen shell reaches the minimum use length, the outer pen shell may be bounced directly to reach the maximum use length and to enter the unused state.

In order to make the inner buckle lug boss better restored through the return slope, the front end of the inner buckle lug boss 211 is also provided with an inner buckle auxiliary slope 2111. The gradient of the inner buckle auxiliary slope 2111 is consistent with the gradient of the return slope 112.

For convenience in mounting the pen point tube into the outer tube, the front end of the contact supporting area 122 is also provided with a mounting auxiliary slope 1221.

In order to ensure the normal use of the buckle extension bodies, and to prevent the buckle extension bodies from contacting the pen point tube when not in use, the fixed extension column 12 has a length greater than the buckle extension bodies 11. The length of the outer fixed column 22 is greater than the length of the inner buckle extension body 21.

In order to cover a gap between the inner buckle extension column and the outer fixed column and to improve the grip comfort, the outer tube 2 is also externally sleeved with an antiskid sleeve 3. The outer surface of the outer tube 2 is also provided with a lantern ring 23. An inner lantern ring groove 31 is arranged inside the antiskid sleeve 3. The inner lantern ring groove 31 is matched with the lantern ring 23.

For convenience in replacing the refill, the anti-falling inner projection is also provided with a replacement slope, so that when the refill needs to be replaced and the pen point tube needs to be separated from the outer tube, the contact supporting area can be separated.

In order to guarantee the normal use, the pen point tube can only be in sliding contact with the inner buckle extension column and is buckled with the inner buckle lug boss without urging against the inner buckle extension column, so that the inner buckle extension column may not affect the normal slide of the pen point tube and the outer tube.

What is claimed is:

1. A lift-pull pen, comprising a pen point tube (1), an outer tube (2), a refill (4) and a return spring (5), wherein the pen point tube (1) and the outer tube (2) are nested to form an outer pen shell; the refill (4) is located in the outer pen shell; the return spring (5) is located in the pen point tube (1) and specifically located between a pen point end of the refill (4) and the pen point tube (1), wherein the pen point tube (1) extends to be provided with one or a plurality of buckle extension bodies (11) and one or a plurality of fixed extension columns (12); the buckle extension body (11) is provided with a buckle projection (111) and a return slope (112); the front end of the buckle projection (111) is also provided with an entrance auxiliary slope (1111); the return slope (112) has certain slope gradient; a matching groove (113) is also arranged between the return slope (112) and the buckle projection (111); the fixed extension column (12) is composed of a contact supporting area (122) and a sliding matching area (121);

the front end of the outer tube (2) extends to be provided with inner buckle extension columns (21) having a same number with that of the buckle extension columns (11) and outer fixed columns (22) having a same number with that of the fixed extension columns (12); the front end of the inner buckle extension column (21) is provided with an inner buckle lug boss (211); the inner buckle lug boss (211) can enter and exit the matching groove (113); the inner side of the outer fixed column (22) is also provided with a fixed chute (24); the fixed extension column (12) is slidably sleeved in the fixed chute (24); the inner side of the front end of the outer fixed column (22) is also provided with an anti-falling inner projection (221); the anti-falling inner projection (221) can slide arbitrarily in a range of a sliding matching area (121) but needs an external force to enter and exit the contact supporting area (122);

the inner buckle lug boss (211) can pass through the buckle projection (111) rapidly to enter the matching groove (113) through the entrance auxiliary slope (1111); then through the gradient of the return slope (112), the inner buckle lug boss (211) and the buckle extension bodies (11) are deformed together; when the external force disappears, under the action of an elastic force of the return spring (5), the buckle extension bodies (11) can be bounced rapidly to leave the return slope (112) contacting same; when the buckle extension bodies are bounced back to a space above the matching groove (113), because the deformed buckle extension bodies are still not restored to a normal state, the inner buckle lug boss (211) leaves a matching range of the matching groove (113) before entering the matching groove (113); and when the buckle extension bodies (11) are restored to a static normal state, the buckle extension bodies already leave a contact range of the pen point tube (1).

2. The lift-pull pen according to claim 1, wherein the position changes of the pen point tube (1) and the outer tube (2) comprise the following two situations:

when the inner buckle lug boss (211) enters the matching groove (113), the pen is in a use state, and at this time, a writing pen point portion of the refill is exposed out of the pen point tube (1);

when the inner buckle lug boss (211) is separated from the matching groove (113) through the return slope (112), the writing pen point of the refill is completely concealed in the outer pen shell, and the inner buckle lug boss (211) and the pen point tube (1) do not contact each other; and the pen is in an unused state.

3. The lift-pull pen according to claim 1, wherein the contact supporting area (122) can separate a partial area to form a self-locking area (13); two sides of the self-locking area (13) are respectively provided with a self-locking projection (131); the inner buckle lug boss (211) can enter the self-locking projection (131).

4. The lift-pull pen according to claim 1, wherein the position changes of the pen point tube (1) and the outer tube (2) comprise the following three situations:

first, when the anti-falling inner projection (221) contacts the contact supporting area (122), the outer pen shell has a maximum use length and the pen is in an unused state, and the refill is in a state of being completely concealed in the outer pen shell;

second, when the inner buckle lug boss (211) stands in the matching groove (113), the pen is in a use state, and the writing pen point portion of the refill has an optimum exposed length;

third, when the inner buckle lug boss (211) contacts the top end of the return slope (112), the outer pen shell has a minimum use length and the pen is in a to-be-released state; if the interference of the external force is relieved after the outer pen shell reaches the minimum use length, the outer pen shell may be bounced directly to reach the maximum use length and to enter the unused state.

5. The lift-pull pen according to claim 3, wherein the position changes of the pen point tube (1) and the outer tube (2) comprise the following four situations:

first, when the anti-falling inner projection (221) contacts the self-locking projection (131) but does not enter the self-locking area (13), the pen is the unused state at this time, and the refill is in a state of being completely concealed in the outer pen shell;

second, when the anti-falling inner projection (221) is matched with the self-locking projection (131) and is located in the self-locking area (13), the outer pen shell reaches the maximum use length and the pen is in the self-locked state, and the refill is in a state of being completely concealed in the outer pen shell and is further retracted into the outer pen shell;

third, when the inner buckle lug boss (211) stands in the matching groove (113), the pen is in a use state, and the writing pen point portion of the refill has an optimum exposed length;

fourth, when the inner buckle lug boss (211) contacts the top end of the return slope (112), the outer pen shell has a minimum use length and the pen is in a to-be-released state; if the interference of the external force is relieved after the outer pen shell reaches the minimum use length, the outer pen shell may be bounced directly to reach the maximum use length and to enter the unused state.

6. The lift-pull pen according to any one of claim 1, wherein the front end of the inner buckle lug boss (211) is also provided with the inner buckle auxiliary slope (2111); and the gradient of the inner buckle auxiliary slope (2111) is consistent with the gradient of the return slope (112).

7. The lift-pull pen according to claim 6, wherein the front end of the contact supporting area (122) is also provided with a mounting auxiliary slope (1221).

8. The lift-pull pen according to claim 7, wherein the length of the fixed extension column (12) is greater than the buckle extension body (11).

9. The lift-pull pen according to claim 8, wherein the length of the outer fixed column (22) is greater than the length of the inner buckle extension column (21).

10. The lift-pull pen according to claim 9, wherein the outer tube (2) is externally sleeved with an antiskid sleeve (3); the outer surface of the outer tube (2) is also provided with a lantern ring (23); an inner lantern ring groove (31) is arranged inside the antiskid sleeve (3); and the inner lantern ring groove (31) is matched with the lantern ring (23).

* * * * *